US006685111B2

(12) United States Patent
Ricco

(10) Patent No.: US 6,685,111 B2
(45) Date of Patent: Feb. 3, 2004

(54) FUEL INJECTOR AND RELATIVE PRODUCTION METHOD

(75) Inventor: Mario Ricco, Casamassima (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 0 days.

(21) Appl. No.: 10/034,633

(22) Filed: Dec. 28, 2001

(65) Prior Publication Data

US 2002/0092936 A1 Jul. 18, 2002

(30) Foreign Application Priority Data

Jan. 16, 2001 (IT) ..... TO2001A0026

(51) Int. Cl.[7] ..... F02M 63/00

(52) U.S. Cl. ..... 239/533.2; 239/533.3; 239/583; 239/584

(58) Field of Search ..... 239/533.2, 533.3, 239/583, 584

(56) References Cited

U.S. PATENT DOCUMENTS

| | | | | | |
|---|---|---|---|---|---|
| 3,499,607 | A | * | 3/1970 | Thomson | 239/533.3 |
| 3,591,081 | A | * | 7/1971 | Andre | 239/533.2 |
| 3,722,801 | A | * | 3/1973 | Chapuis | 239/584 |
| 4,163,521 | A | | 8/1979 | Roosa | 239/86 |
| 4,938,193 | A | | 7/1990 | Raufeisen et al. | 123/470 |
| 6,102,302 | A | * | 8/2000 | Nishimura | 239/533.2 |

FOREIGN PATENT DOCUMENTS

| | | |
|---|---|---|
| GB | 2197386 | 5/1988 |
| WO | 0136811 | 5/2001 |

* cited by examiner

*Primary Examiner*—Robin O. Evans
(74) *Attorney, Agent, or Firm*—Ladas & Parry

(57) ABSTRACT

A fuel injector has an injector body and a fitting for connecting the injector body to a high-pressure fuel supply conduit. The injector body and the fitting are separate elements of the injector, and are connected to each other to connect the supply conduit and grip an end portion of the supply conduit between the injector body and the fitting.

7 Claims, 2 Drawing Sheets

FUEL INJECTOR AND RELATIVE PRODUCTION METHOD

The present invention relates to a fuel injector.

More specifically, the present invention relates to a fuel injector for an internal combustion engine, to which the following description refers purely by way of example.

BACKGROUND OF THE INVENTION

A known internal combustion engine fuel injector comprises an injector body housing a fuel metering valve; and a fitting for connecting the injector body to a high-pressure fuel supply conduit. A known injector body is elongated and tubular in shape, extends along a given axis, and is integral with the fitting connecting the body to the high-pressure fuel supply conduit; and the fitting is located along a lateral wall of, and projects radially with respect to, the injector body. The injector body and fitting are formed from a single rough piece of metal which is hot forged to form an elongated semifinished part having a laterally-extending portion imparting an symmetrical shape to the semifinished part. The asymmetrical semifinished part is then machined to define the injector body and the fitting according to given design parameters, and in particular according to given dimensions, tolerances and surface finish.

Known injectors are expensive to produce on account of the type and number of mechanical operations involved in producing the injector body and fitting, and of which forging is especially expensive and difficult to implement in a continuous-flow system.

SUMMARY OF THE INVENTION

It is an object of the present invention to provide an injector which can be produced using a production method which is much cheaper than those of known injectors, but which at the same time provides for at least the same quality standard.

According to the present invention, there is provided a fuel injector comprising an injector body connectable to a high-pressure fuel supply conduit, and a fitting for connecting said supply conduit to said injector body; the injector being characterized in that said injector body and said fitting are separate elements of said injector and connected to each other.

Such an injector provides not only for eliminating high-cost forging, but also for simplifying machining, on account of the injector body being symmetrical and so adapting better to automatic handling and practically any type of machining operation.

In a preferred embodiment of the invention, the injector body is machined from a bar.

This solution is especially advantageous by the semifinished part being formed from a bar, so that forging is replaced by a cutting operation which is easily implemented in a continuous-flow system. Moreover, the semifinished part, like the injector body, is already symmetrical.

The present invention also relates to a method of producing the injector according to the present invention.

According to the present invention, there is provided a method of producing a fuel injector, characterized by cutting off a bar a cylindrical semifinished part to form the injector body.

In a preferred embodiment of the method according to the present invention, an end portion of the supply conduit is deformed between the injector body and the fitting.

This solution is especially advantageous by not requiring that the fitting be fixed hermetically to the injector body, in that the fitting provides for gripping and deforming the end portion of the supply conduit between itself and the injector body to form a hermetic seal between the injector body and the supply conduit. Hermetic sealing is ensured by deformation of the end portion of the supply conduit gripped between the injector body and the fitting.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
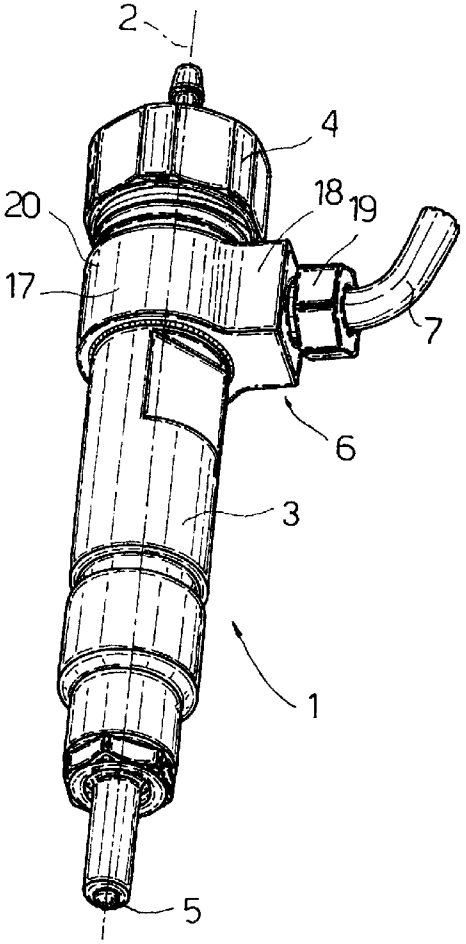
FIG. 1 shows a view in perspective of an injector.

Number 1 in FIG. 1 indicates as a whole an internal combustion engine fuel injector.

Injector 1 extends along an axis 2 and comprises an injector body 3; a cap 4 fixed to injector body 3; a nozzle 5 fixed to injector body 3 at the opposite end to cap 4; and a fitting 6 fixed to injector body 3 to connect injector body 3 to a high-pressure fuel supply conduit 7. The pressure of the fuel fed along supply conduit 7 exceeds a thousand bars.

Figure 2:
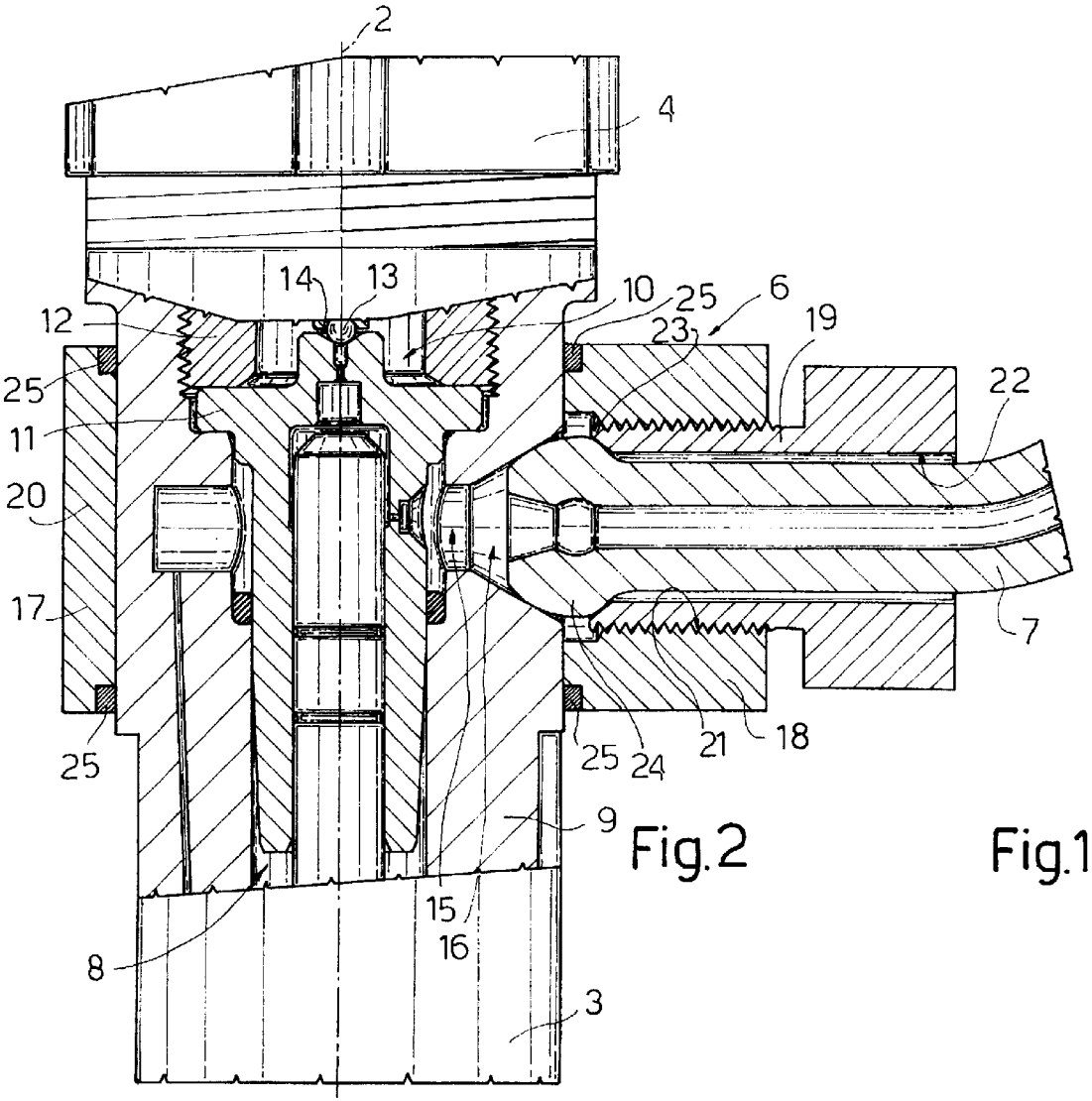
FIG. 2 shows a larger-scale section of part of the FIG. 1 injector.

With reference to FIG. 2, injector body 3 is tubular, and comprises an inner chamber 8 defined laterally by a substantially cylindrical wall 9. Injector 1 comprises a valve 10 housed in chamber 8 and in turn comprising a valve body 11 fixed to injector body 3 by a ring nut 12, and a shutter 13 held inside a seat 14 in valve body 11 by a spring not shown in FIG. 2. Injector body 3 comprises a hole 15 which extends through a cylindrical portion of wall 9 to form an opening permitting access to inner chamber 8 of injector 1, and which has a flared or truncated-cone-shaped portion 16 to form a funnel flaring outwards of wall 9.

Fitting 6 comprises a substantially cylindrical ring 17; an attachment 18 integral with and projecting from ring 17; and a sleeve 19 fitted to attachment 18. Ring 17 has a cylindrical wall 20 blending with attachment 18 and which fits about wall 9 of injector body 3; attachment 18 has a threaded hole 21 which, when fitting 6 is connected to injector body 3, is aligned with hole 15; and sleeve 19 is threaded externally, is screwed to attachment 18, and has a hole 22, an end portion 23 of which is flared or truncated-cone-shaped and faces flared portion 16 of hole 15.

Conduit 7 is smaller in diameter than hole 22 of sleeve 19, and comprises a ring-shaped end portion 24 larger in diameter than hole 22. In actual use, end portion 24 of conduit 7 is located between injector body 3 and sleeve 19, at flared portion 16 of hole 15 on one side, and at flared portion 23 of hole 22 on the opposite side, and is gripped between sleeve 19 and injector body 3 to deform the material of end portion 24 and so ensure hermetic sealing of the high-pressure fuel with no need for seals.

Figure 3:
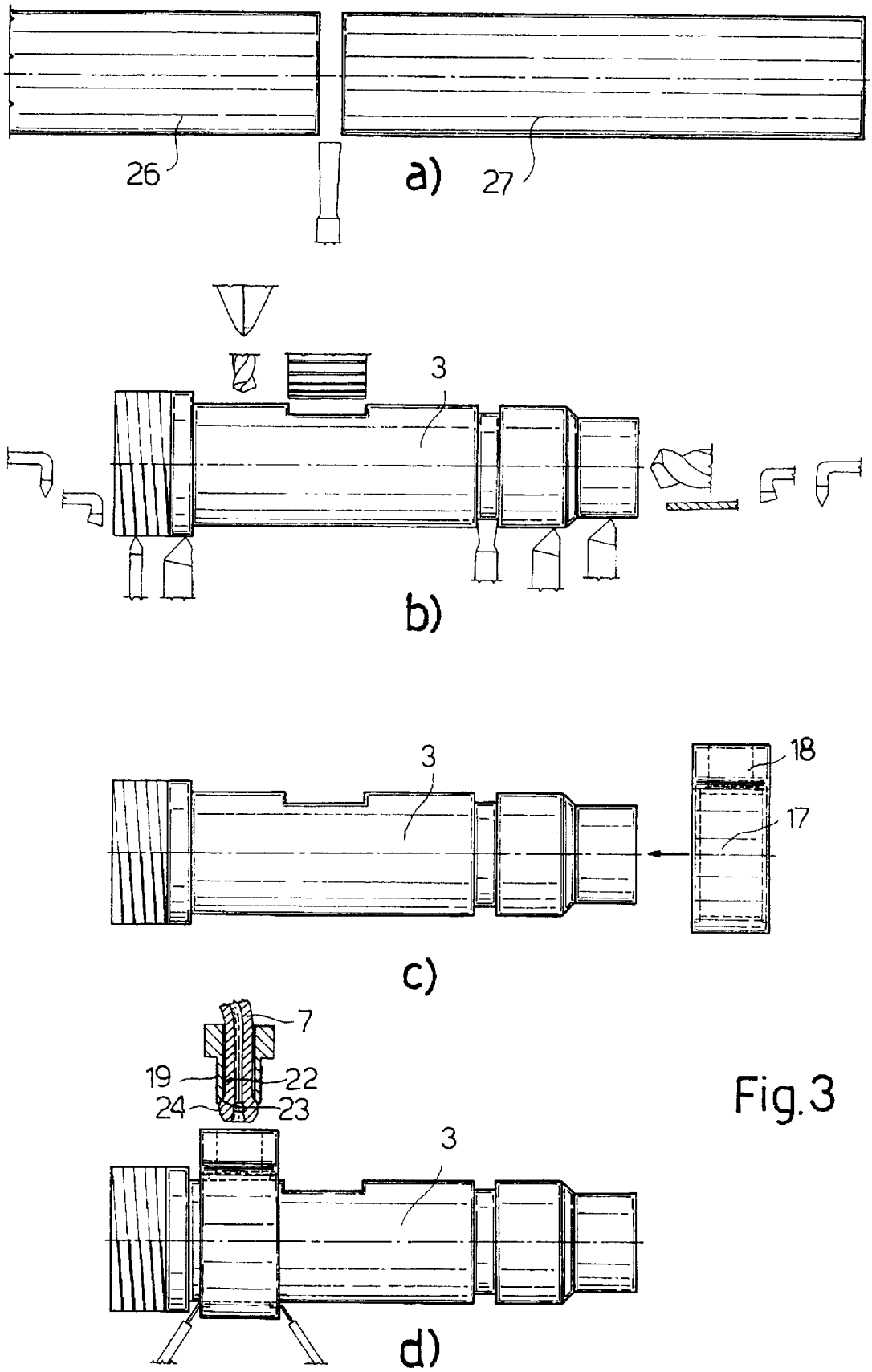
FIGS. 3*a*–3*d* show, schematically, a number of steps in the method of producing the FIG. 1 injector.

With reference to FIGS. 3*a* and 3*b*, no forging is required, only machining and assembly operations, to produce injector 1; and injector body 3 is machined from a bar 26 of metal.

As shown in FIG. 3*a*, bar 26 is cut into semifinished parts 27, each of which is machined, as shown schematically by various machining tools in FIG. 3*b*, to form injector body 3 to prescribed dimensions, tolerances and surface finish. Once formed, injector body 3 is connected to fitting 6 as shown in FIGS. 3*c* and 3*d*. Fitting 6 is formed separately by means of similar machining operations, and is then fixed to injector 3 by brazing or weld spots 25 which distribute stress about ring 17 when gripping conduit 7, and which keep hole 21 aligned with hole 15. FIGS. 3*c* and 3*d* show connection of injector body 3 to ring 17 and attachment 18 of fitting 6, though valve 10, nozzle 5, cap 4 and other component parts of injector 1 not shown in the drawings may be fitted first.

Once ring 17 is fixed to injector body 3, sleeve 19 is fitted about supply conduit 7 and screwed to attachment 18 to grip and deform end portion 24 of conduit 7 between injector body 3 and fitting 6.

Clearly, changes may be made to the form of the fitting without departing from the scope of the present invention. For example, in a variation (not shown) of the present invention, the fitting comprises, in place of ring 17 and attachment 18, a cylindrical ring having a threaded hole defining an attachment for sleeve 19, so that the injector is even simpler to produce by simplifying the fitting.

What is claimed is:

1. A fuel injector comprising:

a tubular injector body (3) including a wall (9) having a receiving hole (15);

a high-pressure fuel supply conduit (7) comprising a ring-shaped end portion (24);

a fitting (6) fixed along said wall (9) at said receiving hole (15) for connecting said supply conduit (7) to said injector body (3) through said receiving hole (15);

said fitting (6) comprising:

a threaded sleeve (19) having a housing hole (22) for housing said supply conduit (7) and gripping said ring-shaped end portion (24) between the injector body (3) and said sleeve (19); said housing hole (22) being smaller in diameter than said ring-shaped end portion (24);

an attachment (18) having a threaded hole (21) aligned with said receiving hole (15) to connect said sleeve (19) to said attachment (18);

a ring (17) integral with said attachment (18);

wherein said wall has a flared portion (16) extending from said receiving hole (15), and said sleeve (19) has an opposing flared portion (23) extending from said housing hole (22) and facing said flared portion (16) of said receiving hole (15); said flared portion (16) of said wall (9) and flared portion (23) of said sleeve (19) flaring in opposite directions and bearing against opposite flared surfaces of said ring-shaped end portion of said supply conduit (7) so that when said sleeve (19) is threadably advanced in said attachment (18), said ring-shaped end portion (24) is deformed between said flared portion (16) of said wall (9) and said flared portion (23) of said sleeve (19) to provide hermetic sealing between said supply conduit (7) and said injector body (3).

2. An injector claimed in claim 1, wherein said injector body (3) is formed from a bar (26) by means of machining operations.

3. An injector as claimed in claim 1, wherein said ring (17) is fixed to the wall (9) of the injector body (3) by brazing.

4. An injector as claimed in claim 1, wherein said ring (17) is fixed to the wall of the injector body (3) by weld spots (25).

5. An injector as claimed in claim 1, wherein said injector (1) is an injector (1) for internal combustion engines.

6. An injector as claimed in claim 1 wherein said flared surface (23) of the sleeve (19) bears directly against the corresponding flared surface of said ring-shaped end portion (24) of said supply conduit (7).

7. An injector as claimed in claim 1 wherein said attachment (18) is fixed to said wall (9).

* * * * *